US005423354A

United States Patent [19]

Herrlein

[11] Patent Number: 5,423,354

[45] Date of Patent: Jun. 13, 1995

[54] DRIVE SYSTEM FOR A LOOM SLAY SHAFT FOR PRODUCING TERRY OR SMOOTH FABRIC

[75] Inventor: Wilhelm Herrlein, Neuravensburg, Germany

[73] Assignee: Lindauer Dornier Gesellschaft mbH, Lindau, Germany

[21] Appl. No.: 204,762

[22] Filed: Mar. 2, 1994

[30] Foreign Application Priority Data

Mar. 3, 1993 [DE] Germany ..... 43 06 612.7

[51] Int. Cl.[6] ..... D03D 39/22

[52] U.S. Cl. ..... 139/26; 139/1 E; 139/188 R

[58] Field of Search ..... 74/54, 57; 139/26, 1 E, 139/188 R

[56] References Cited

U.S. PATENT DOCUMENTS

| | | | |
|---|---|---|---|
| 3,363,653 | 1/1968 | Nichols | 139/26 |
| 3,425,458 | 2/1969 | Nichols et al. | 139/26 |
| 3,467,146 | 9/1969 | Tiernan | 139/26 |
| 3,877,492 | 4/1975 | Nelson | 139/26 |
| 5,058,628 | 10/1991 | Spiller et al. | 139/26 X |

FOREIGN PATENT DOCUMENTS 0350446 4/1992 European Pat. Off. .

*Primary Examiner*—Andrew M. Falik

*Attorney, Agent, or Firm*—W. G. Fasse; W. F. Fasse

[57] ABSTRACT

A drive system for a weaving loom includes at least one four-pivot three-link drive or preferably two such drives for transmitting drive power from a main loom shaft through a cam drive to a slay shaft coupled to the cam drive through the four-pivot three-link drive. The use of two four-pivot three link drives permits operating the weaving loom selectively for producing terry cloth and/or smooth fabric. Each of the four-pivot three-link drives (DL, DR) has four pivots or journals (A, B, C, D) and three links (24, 38, 43; 25, 40, 44). Each four-pivot three-link drive cooperates with a roller carrying cam follower (15) that is controlled by an eccentric cam assembly (7). Both four-pivot three-link drives effectively operate the slay shaft (46) of the loom. A control and engagement mechanism (33, 54) provides for the switching from one four-pivot three-link drive to the other and vice versa, whereby a switch-over from the production of one type of fabric to the other is facilitated.

24 Claims, 9 Drawing Sheets

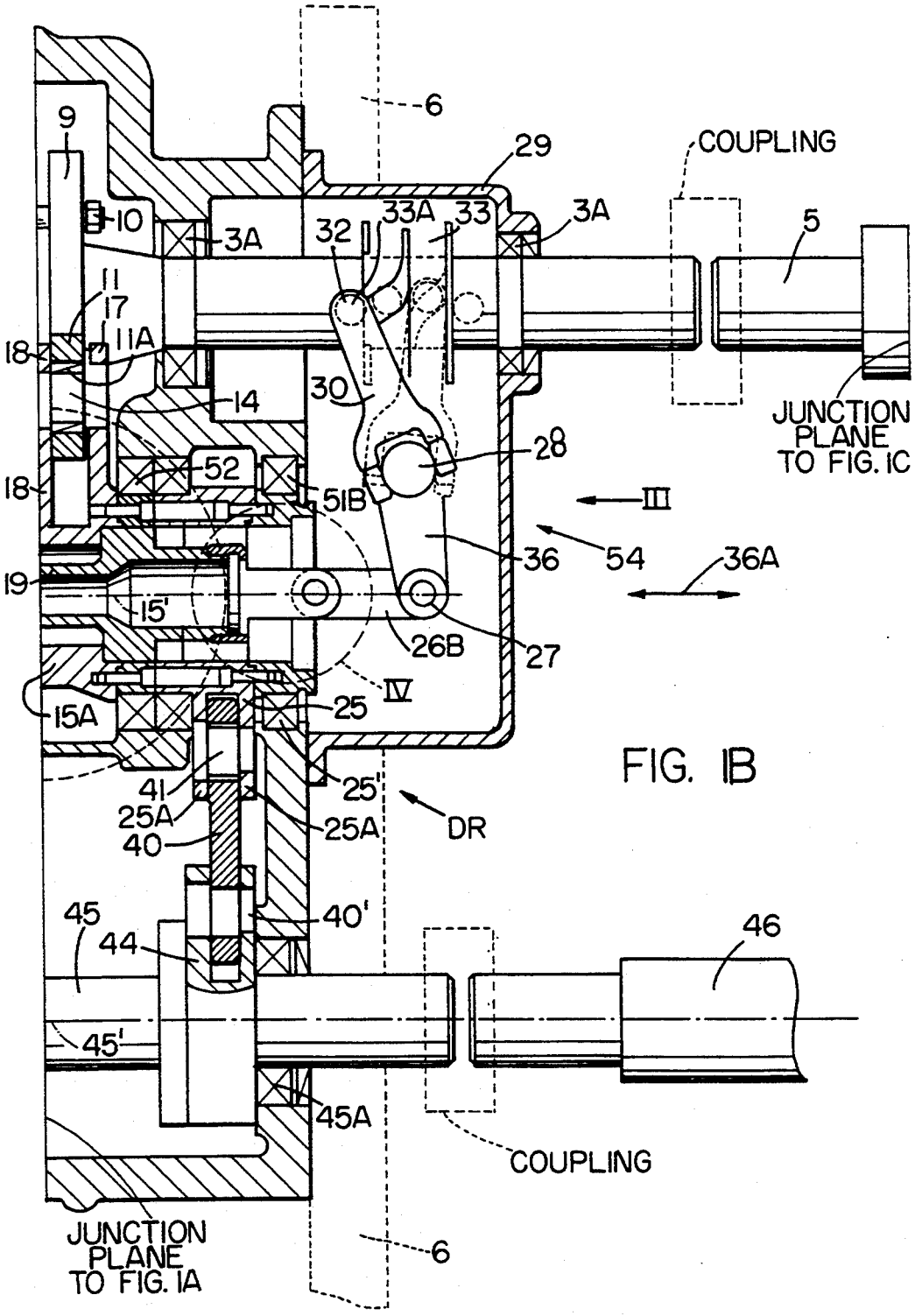
6
9
29
COUPLING
10
3A
32
33A
33
3A
5
11
17
11A
18
14
30
JUNCTION PLANE TO FIG. IC
28
52
18
51B
III
36
54
36A
19
15'
26B
27
IV
15A
25
FIG. IB
41
25'
25A
25A
DR
40
45
40'
46
44
45'
45A
COUPLING
JUNCTION PLANE TO FIG. IA
6

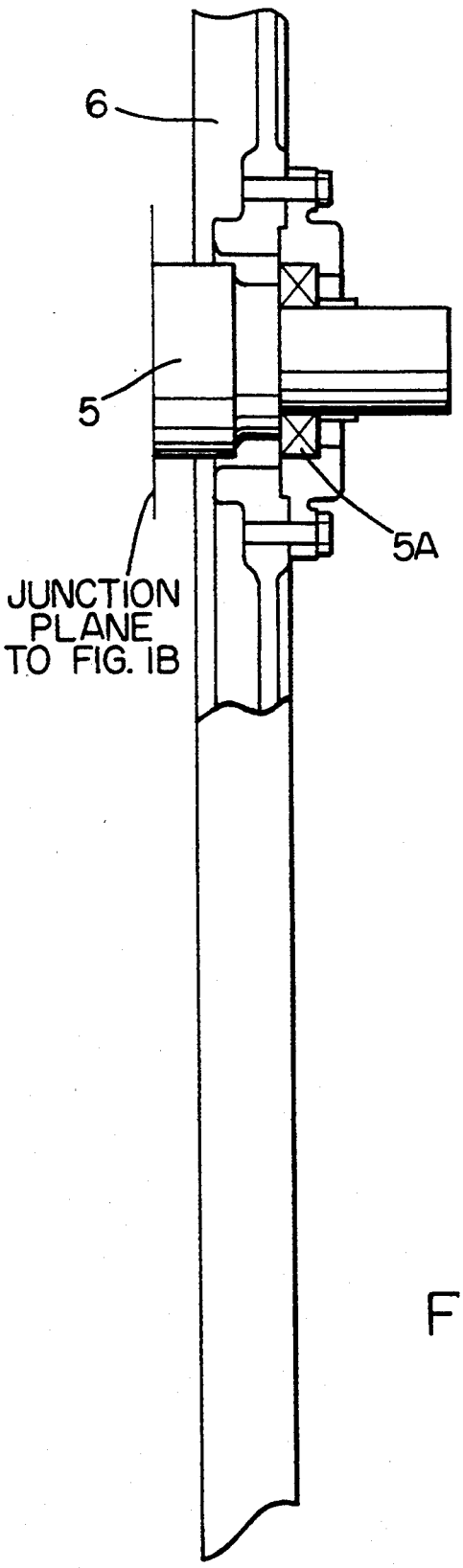
FIG. IC

DRIVE SYSTEM FOR A LOOM SLAY SHAFT FOR PRODUCING TERRY OR SMOOTH FABRIC

FIELD OF THE INVENTION

The invention relates to a drive system including a cam drive and at least one four-pivot three-link drive for controlling an angular motion especially of a slay shaft in a weaving loom. The drive system is interposed between the main loom drive shaft and an output or driven shaft that drives the slay shaft. The drive system is so constructed that the slay shaft is driven to have a selectable constant stroke for weaving smooth fabric or that the slay shaft has a variable stroke for weaving terry cloth. The term "stroke" or "angular stroke" as used herein refers to the controllable angular range in which the loom slay shaft can perform the beat-up motion of the reed.

BACKGROUND INFORMATION

Looms for weaving terry cloth require gear drives that are capable of driving two different motion sequences, since it is necessary to position the slay shaft at different angular orientations for the formation of the terry loops or nap. For example, one orientation of the slay shaft must enable the formation of a partial beat-up for forming the pile depth of the warp threads for the terry cloth being woven, while the other angular position of the slay shaft must enable the full beat-up motion of the reed.

European Patent Publication EP-0,350,446 (Spiller et al.), published Jan. 10, 1990, describes a method and a loom for weaving terry cloth with features for the terry pile or nap formation. In the known loom the several angular positions of the slay shaft and thus of the reed are achieved in accordance with the principle of a so-called toggle slay comprising a plurality of articulated toggle levers. One of these articulated toggle levers bears against an eccentric cam assembly which is rigidly coupled to the main drive shaft of the loom. The toggle levers influence the angular position of the reed relative to a cam follower lever also referred to herein as roller carrying lever or simply as cam follower. The toggle lever is connected to a respective adjustment drive for varying or adjusting the position of the toggle lever, whereby the just described features of the known apparatus make it possible to adjust the toggle lever translation ratio of the toggle slay in the direction of the reed or rather relative to the beat-up line.

In connection with the use of a gear drive which cooperates with a toggle slay, there is the drawback that the kinematic system altogether is inherently "soft". In the present context the term "soft" means that the position of the pivots or journal axis of the system cannot always be exactly reproduced to assume the same position at all times. This drawback of a toggle slay leads to a certain inaccurate beat-up motion of the slay for the formation of the terry pile or nap. The adjustment drive of the known slay drive system has a spindle for the adjustment and positioning. Nevertheless, such a spindle drive has the disadvantage that it is not compatible with the high r.p.m. of the main loom drive shaft because a rapid sequence of adjustment motions is necessary and such motions have their speed limitation when a toggle slay is used.

Furthermore, the use of a plurality of interacting toggle levers has the disadvantage of a substantial inertia which also militates against the use of a high speed drive shaft r.p.m. The inertia of the toggle lever system also has an adverse influence on the wear and tear resistance of the bearings in the entire system.

OBJECTS OF THE INVENTION

In view of the foregoing it is the aim of the invention to achieve the following objects singly or in combination:

- to provide a cam drive and at least one four-pivot three-link drive for driving an angularly movable component or output shaft with a selectable constant or variable angular stroke;
- to construct a slay drive mechanism with a cam drive and with two four-pivot three-link drives, especially for shuttleless weaving looms, for selectively producing terry cloth and/or smooth fabric on the same loom;
- to construct a loom drive mechanism with due regard to inertia considerations so that the high speed input r.p.m. of a modern loom input drive shaft can be fully utilized for an output shaft in the loom for the adjustment of the loom slay beat-up angle either alternately or so that the adjustment alternates, whereby it is possible to weave smooth fabric or terry cloth or both in an alternating sequence in the same weaving operation;
- to avoid the use of so-called toggle lever slay and thus its drawback of not being suitable for taking full advantage of the high operational speed of which modern weaving looms are capable;
- to provide for an adjustment of the terry pile depth in a loom that is suitable for producing terry cloth or on a loom that is suitable for producing either terry cloth or smooth cloth, whereby adjusted pile depth controlling elements shall be lockable in an adjusted position; and
- to provide a simple adjustment drive for a sliding or shifting shaft in a loom for selectively producing terry cloth or smooth fabric, yet assuring an exact adjustment of the shifting shaft, while simultaneously taking advantage of the high speed capabilities of modern shuttleless looms.

SUMMARY OF THE INVENTION

The drive system according to the invention comprises an adjustable drive transmission for selectively controlling an angular motion and an angular range of the motion, especially in a weaving loom, wherein an angularly movable component forms for example the slay shaft of the loom. The slay shaft is driven by a power input unit (1, 1A) including a driving main loom shaft (3), an eccentric drive cam assembly (7) driven by the main shaft (3) and preferably rigidly connected to the main shaft; for rotation with the main loom shaft. A cam follower (15), such as a lever (15) carrying cam follower elements such as rollers (11, 12), engages the eccentric drive cam assembly (7). At least one first four-pivot three-link drive (DL or DR) is coupled to the cam follower (15). The at least one first drive (DL) comprises a linkage having four pivots or journals (A, B, C, D) and three links (24, 38, 43) interconnecting these journals. Connecting elements (19, 54) connect the four-pivot three-link drive (DL or DR) to the angularly movable component (45, 46) for transmitting drive power to the angularly movable component.

A preferred embodiment of a drive system of the invention combines the following features. A drive cam assembly (7) driven by the main shaft (3) drives a cam follower (15). The cam follower in turn drives selectively a first four-pivot three-link drive (DL) or a second four-pivot three-link drive (DR) for operating a power output or drive shaft (45), for example the slay shaft (46) in a loom. The slay shaft is operated according to the invention to either have a constant or a variable angular stroke as defined above. The stroke is selectively switchable either by an operator or by a program. A drive motor is connected to the power or input driving shaft (3). The power transmission is accomplished by the cam drive (7, 15) and the first (DL) or the second four-pivot three-link drive (DR) responsive to the rotation of the main loom shaft. The drive cam assembly includes two cams (8, 9) driven by the main loom shaft (3), and the tiltably mounted cam follower (15) is carrying a cam follower element (11, 12) for each cam (8, 9), such as cam follower rollers (11, 12). Each of the four-pivot three-link drives (DL, DR) includes connector links, namely (24, 38, 43) for the first or left drive (DL) and (25, 40, 44) for the second or right drive (DR) linking the cam follower (15) to the driven shaft (45). The eccentric drive cams (8, 9) of the cam assembly (7) are arranged on or preferably rigidly connected to the main loom shaft (3) for rotation therewith. The cam assembly has a circumferential cam contour or contours in contact with the cam follower rollers (11, 12) carried by the cam follower (15). A switching or engaging mechanism (54) operatively connects one or the other of the four-pivot three-link drives (DL or DR) with the cam follower (15). Each of the four-pivot three-link drives (DL, DR) has a one pivot or journal axis (A) arranged coaxially to a tilting axis (15') of the cam follower (15). One four-pivot three-link drive is positioned on each side of and spaced from the cam follower (15)in a housing (4). The first drive (DL) is positioned on the left side of and with a spacing (22) from the cam follower (15). The second drive (DR) is positioned on the right side of and with a spacing (23) from the cam follower (15).

The switching or engaging mechanism (54) includes a coupling which couples one or the other of the four-pivot three-link drives (DL, DR) with the cam follower (15). This switching is controlled either by an operator or preferably by a program so that either one or the other drive (DL or DR) is effectively coupled with the cam follower (15) during a weaving operation. The switching may even be performed during a weaving operation so that these drives are switched on and off in an alternating sequence. When one four-pivot three-link drive (DR) is switched on, a smooth fabric is produced. When both four-pivot three-link drives (DL and DR) are switched on and off in an alternating fashion, a terry cloth is produced. A hub (15A) in the form of a hollow shaft for the cam follower (15) surrounds concentrically the tilting axis (15') of the cam follower (15). First, entraining elements (20A, 21A) are arranged at each free end of the hub (15A). A slidable shifting shaft (19) extends, preferably concentrically, through the hollow hub (15A) so that the shifting shaft (19) can engage with its own second entraining elements (19C, 19D) alternatively or alternatingly one or the other of the first entraining elements (20A, 21A) of the hub (15A) of the cam follower (15). The engaging mechanism (54) is coupled with the sliding shaft (19) for moving the shaft (19) axially either from right to left or from left to right. For this purpose the engaging mechanism (54) is operatively coupled with a control device (33) arranged on the power input or drive shaft (3). At least one of the two four-pivot three-link drives (DL or DR) comprises elements (24C, 57, 59) for adjusting the rotational angle or stroke of the driven shaft (45) or slay shaft (46), thereby determining the pile depth of a terry cloth to be woven. The at least one four-pivot three-link drive with the elements for determining the pile depth comprises a locking mechanism (60) for arresting the pile depth determining elements (24C, 57, 59) in their adjusted position.

In the just described preferred embodiment of the invention of the two four-pivot three-link drives (DL and DR), at least one drive is constructed to be adjustable for determining the angular range while the other drive may or may not be adjustable. A coupling device is arranged between the cam follower and the first and second four-pivot three-link drives for switching one or the other drive into an active connection with the cam follower which thus operates both drives in response to a control device which in turn is responsive to or arranged on the main loom drive shaft. Thus, it is possible to use the DR alone or both of the four-pivot three-link drives are switched in an alternating sequence. The just described arrangement avoids the above mentioned toggle slay of the prior art and thus the disadvantages of toggle slays. According to the invention, the angular stroke of the slay shaft and thus of the slay is achieved with exactness, since the positions of the four pivots of the three-link drives is positively enforced at all times.

The fact that at least one of the two four-pivot three-link drives has at least one position adjustable pivot or journal (B, 37) according to the invention has the advantage that at the beginning of each weaving operation the operator or a program can select the desired pile depth of the terry cloth to be woven. Such selection is accomplished by a simple adjustment of an angular stroke adjustment device. For practical purposes it is sufficient that one four-pivot three-link drive is adjustable while the other is not. Thus, the other non-adjustable four-pivot three-link drive can, for example, be realized by a gear wheel drive which does not even require full gear wheels, rather, gear segments are sufficient for the pile depth selection. For example, the adjustable four-pivot drive is arranged on one side of the cam follower lever and the other drive is arranged on the opposite side of the cam follower lever.

The above mentioned coupling device is preferably a gear clutch that can be axially shifted for engaging one or the other drive to transmit the oscillating movement of the cam follower to the engaged drive. The gear clutch preferably includes a slidable shifting shaft that has at each of its free ends an outer gearing for meshing with an inner gearing provided in the hollow hub of the cam follower. By shifting the slidable shaft into one or the other end position an engagement between the cam follower and the respective drive will be established through the shifting shaft. In each end position of the shiftable shaft, one of the drives will be engaged, while the other will be disengaged, and vice versa. Thus, depending on the axial position of the shifting shaft, the oscillation of the cam follower lever is transmitted either to one or the other four-pivot three-link drive which are positioned for this purpose on opposite sides of the cam follower lever as mentioned.

The use of at least one, preferably two, four-pivot three-link drives according to the invention has the advantage that an exact transmission of the main drive shaft rotation through the cam follower and the four-pivot drives is achieved, whereby the transmission is practically free of play to assure an exact angular drive of the slay shaft. This type of construction assures an exact slay shaft adjustment or control through the axially slidable shaft even at the high r.p.m. of the input main loom shaft in modern weaving looms. This advantage of the invention is due to the fact that the power transmission train with the four-pivot three-link drives has a relatively small mass so that the present drives can follow the high r.p.m. even for the pile formation at an exactly predetermined angular movement of the slay shaft. Further, this exact angular movement or position of the slay shaft is accurately repeatable.

It is a further important advantage of the invention that the combination of the cam follower with two four-pivot three-link drives can be used for the formation of terry cloth or for the weaving of a smooth fabric. Additionally, when the loom is intended for smooth fabric only, the use of a single four-pivot three-bar drive is sufficient. In that case, the shifting shaft is not required so that the cam follower cooperating with the eccentric assembly driven by the main shaft, can directly drive the single four-pivot three-link drive which in turn is coupled to the slay shaft.

In the embodiment for a loom that is intended to produce both smooth fabric and terry cloth, a single eccentric assembly and a single cam follower are sufficient. However, as mentioned, the oscillation of the cam follower is switched by the shifting shaft to drive one or the other of the two drives, at least one, preferably both are four-pivot three-link drives as described. The control of the shifting is also derived from the rotation of the main loom shaft.

BRIEF DESCRIPTION OF THE DRAWINGS

In order that the invention may be clearly understood, it will now be described, by way of example, with reference to the accompanying drawings, wherein.

Figure 1A:
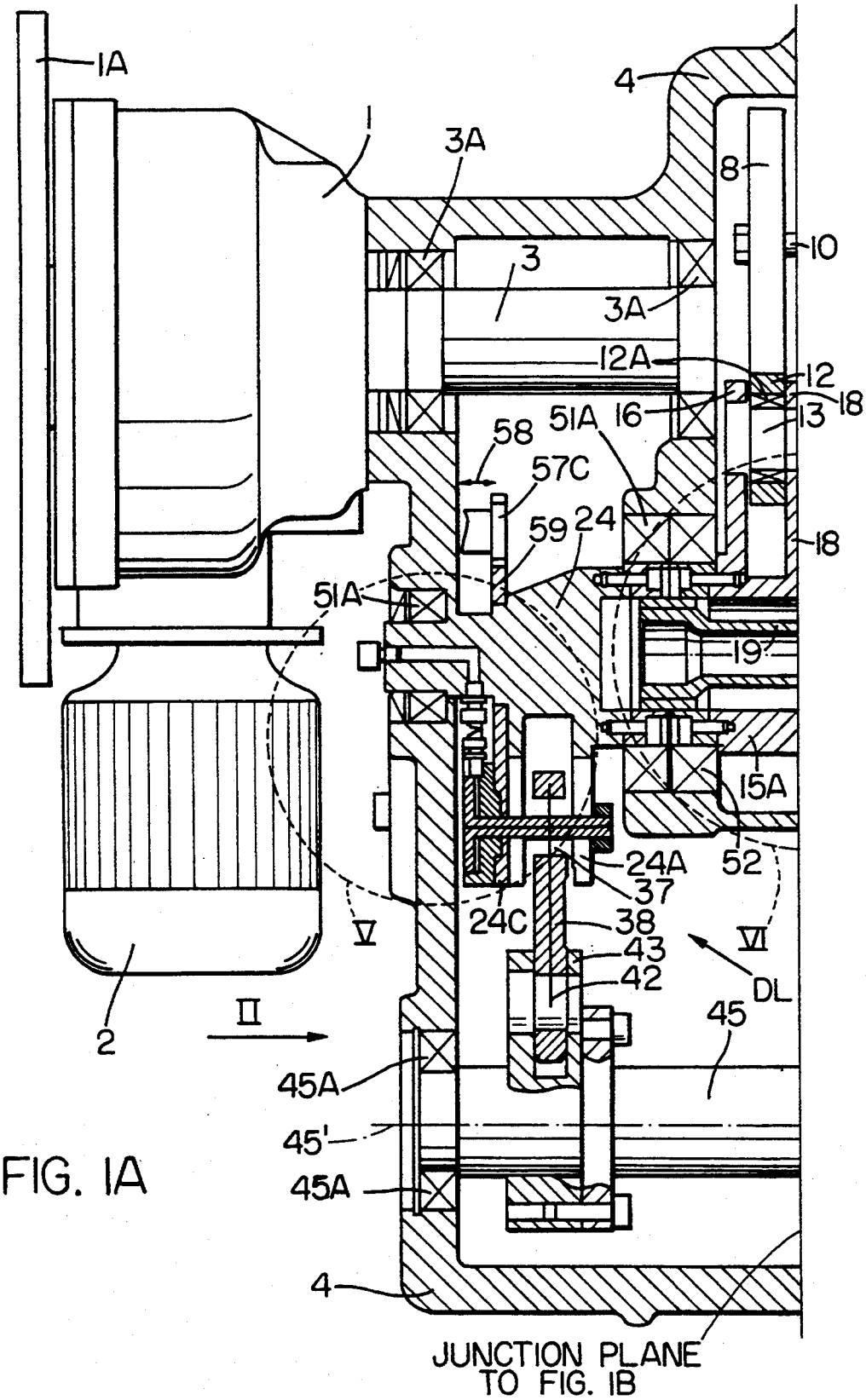
FIG. 1 is a sectional view through a drive system according to the invention approximately along section line I—I in FIG. 2, illustrating an embodiment with two four-pivot three-link drives capable of producing a smooth fabric, or a terry cloth, or both, wherein one left drive is positioned to the left of a cam follower and the other right drive is positioned to the right of the cam follower.

DETAILED DESCRIPTION OF PREFERRED EXAMPLE EMBODIMENTS AND OF THE BEST MODE OF THE INVENTION

FIG. 1 shows a gear case or housing 4 having mounted therein a main loom driving shaft 3 supported by bearings 3A. The housing 4 has a cover 29 on the right-hand side thereof, where the gear housing 4 is also flanged at 4A to a loom frame 6. The rotatably mounted main driving loom shaft 3 is driven by a main drive 1 including a main drive motor not shown. A clutch and brake combination 1A connects the conventional main drive motor to the main drive 1. A reverse motor 2 is connected conventionally to the main drive 1. The reverse motor 2 is used for so-called back weaving, for example, when a weft thread must be repaired.

The drive shaft 3 is conventionally connected through a coupling to the loom shaft 5 which is mounted by bearings 5A in the loom frame 6.

Figure 2:
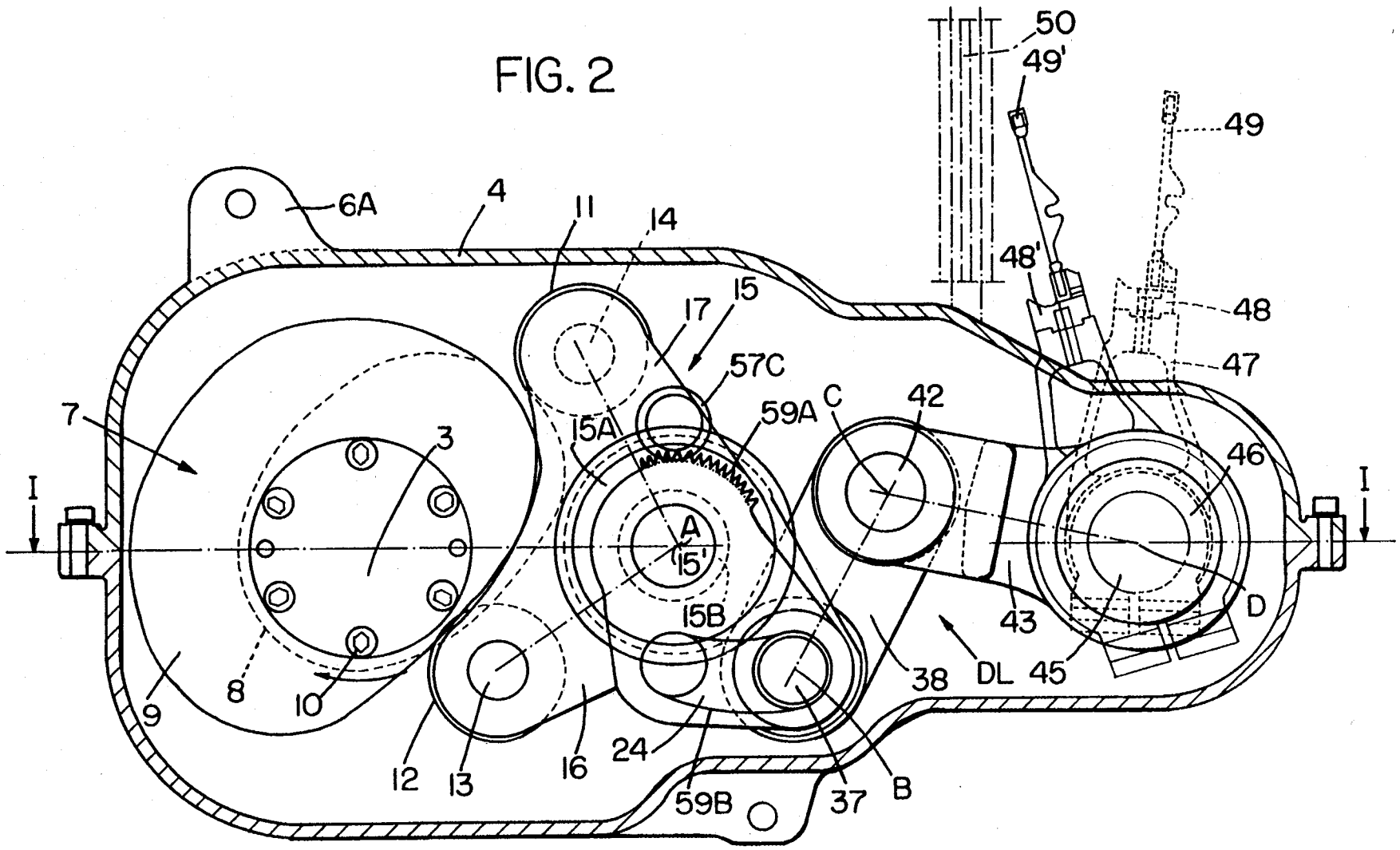
FIG. 2 is a side view, partially in section, in the direction of the arrow II in FIG. 1, showing the details of a four-pivot three-link drive according to the invention.

Eccentric cams 8 and 9 held together by nuts and bolts 10 form an eccentric assembly 7 rigidly mounted on the driving main loom shaft 3 so that the drive power of the main loom shaft 3 is applied to and transmitted by the assembly 7 to a cam follower 15 best seen in FIG. 2. The cam follower 15 has a hub 15A forming a hollow shaft having a tilting axis 15'. The hollow hub 15A is mounted in bearings 52 best seen in FIG. 6.

Referring to FIGS. 1 and 2, the cam follower 15 has a first leg 16 carrying a cam follower roller 12 mounted on a journal shaft 13 by a bearing 12A. The cam follower 15 has a second leg 17 carrying a further cam follower roller 11 on a journal shaft 14 and a bearing 11A. The roller 12 contacts the surface of the cam 9. The roller 11 contacts the surface of the cam 8. A third leg 18 of the cam follower 15 holds the respective inner end of the journal shafts 13 and 14. Thus, the roller 12 is positioned between the third leg 18 and the first leg 16 while the roller 11 is positioned between the third leg 18 and the second arm 17.

Figure 5:
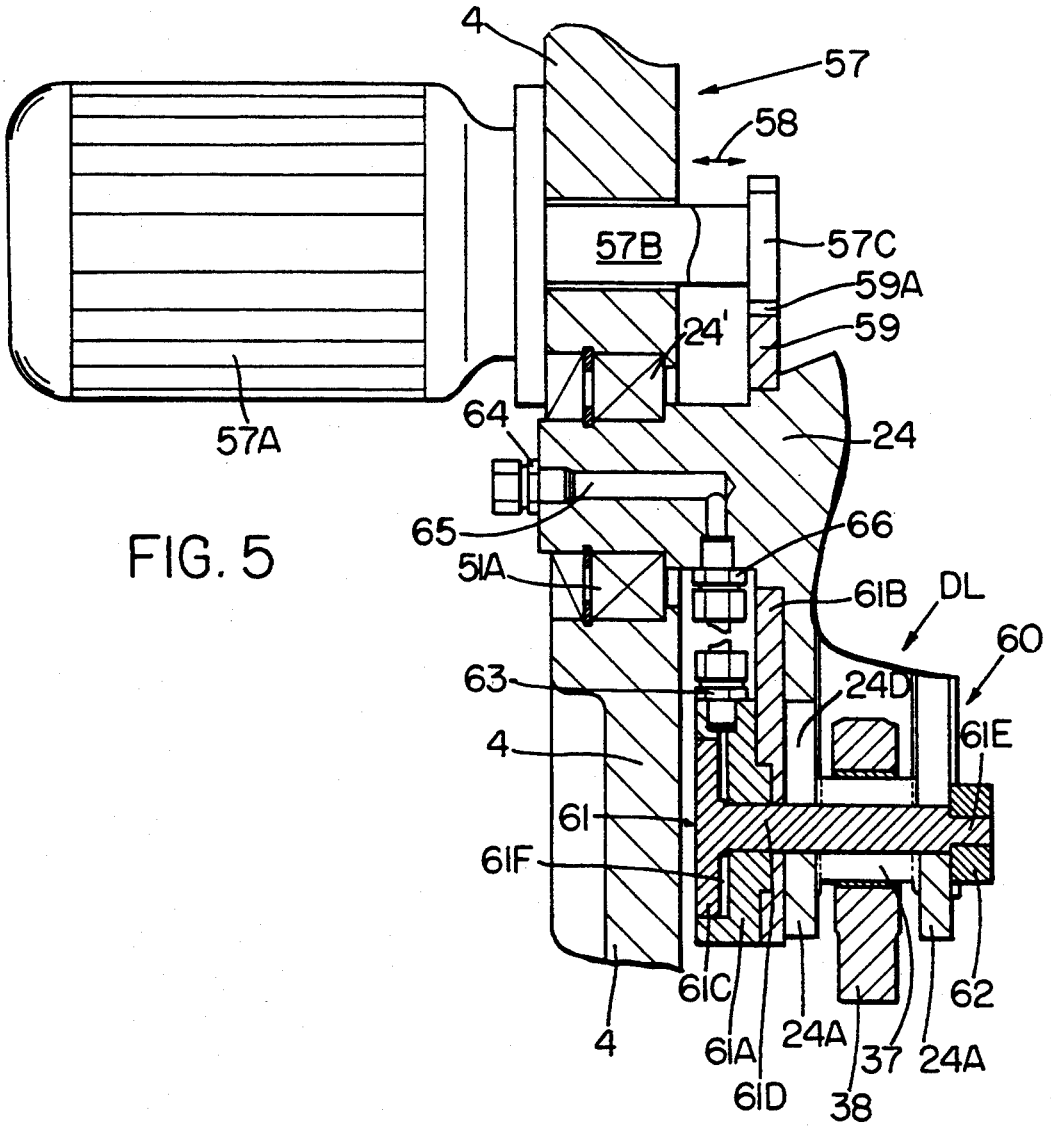
FIG. 5 is an enlarged view of the detail V in FIG. 1, illustrating the angular stroke adjustment components on the left-hand side of FIG. 1, including a device for arresting the components for the angular adjustment in an adjusted position.
Figure 6:
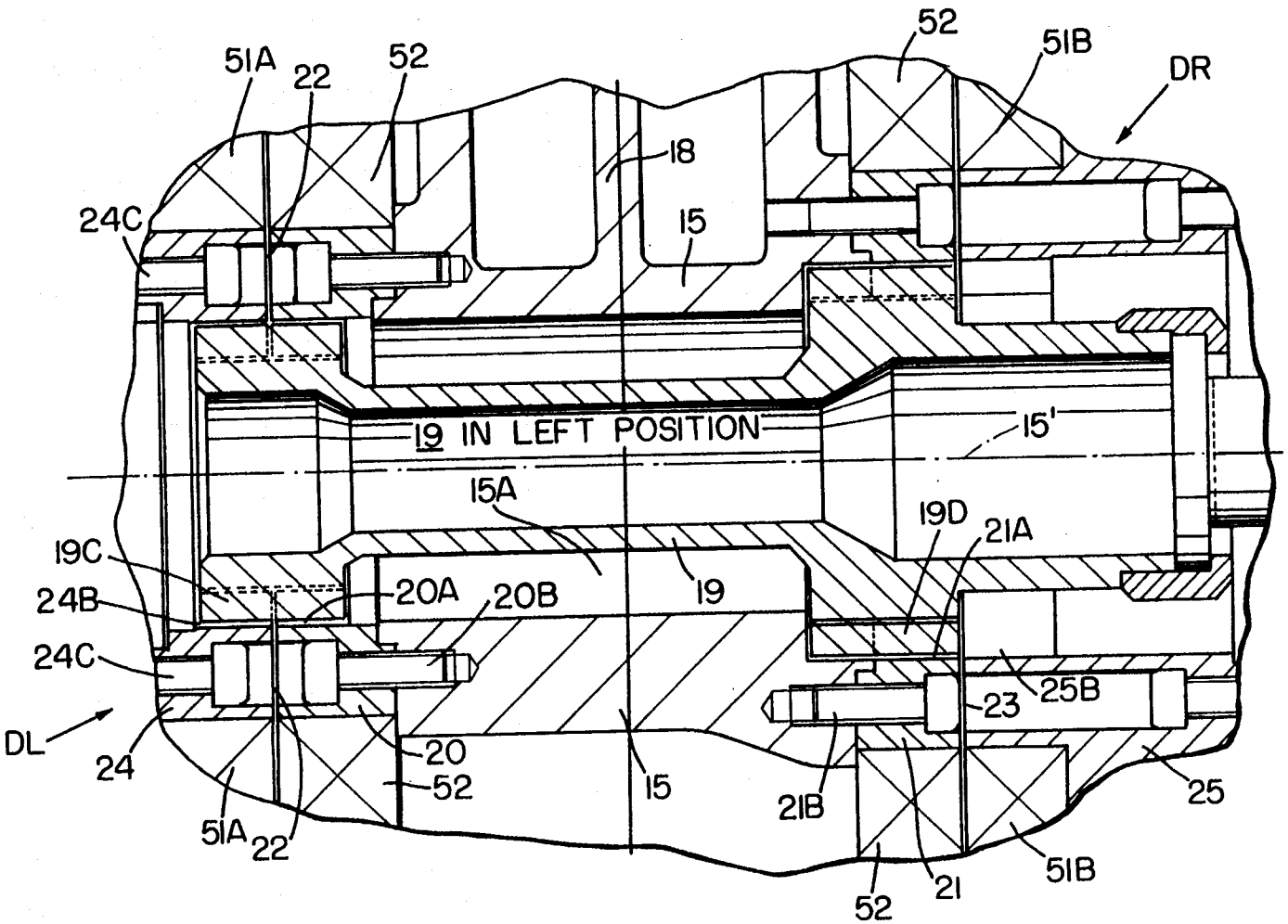
FIG. 6 shows the detail VI in FIG. 1 on an enlarged scale, illustrating a hollow hub of the cam follower, whereby the shifting shaft is arranged coaxially inside the hollow hub, and positioned for driving the left four-pivot three-link drive.

Referring to FIGS. 1, 2, 5 and 6 in conjunction, a coupling or connecting device that selectively connects the cam follower 15 to the left-hand four-pivot three-link drive DL will now be described. As shown in FIG. 6, the hollow hub 15A of the cam follower 15 has a tilting axis 15' and inwardly facing entraining elements such as a gear or gear ring 20A at its left end and a gear or gear ring 21A at its right end. These gear rings 20A and 21A may either be an integral component of the hub 15A or gear rims 20, 21 with respective inwardly facing gear teeth 20A, 21A may be connected to the hub 15A by screws 20B and 21B.

The four-pivot three-link drive DL arranged on the left-hand side of the cam follower 15 as shown in FIGS. 1 and 6, comprises three links 24, 38 and 43 and four pivots A, B, C and D seen in FIG. 2. The first link 24 has an inwardly facing gear ring 24B, the teeth of which are axially aligned with the teeth of the inwardly facing gear 20A. The inwardly facing gear ring 24B of the link 24 may be a gear rim forming an integral part of the link 24 or the gear rim 24B may be connected to the lever 24 by screws 24C. An axially slidable shifting shaft 19 is arranged inside the hollow hub 15A, preferably coaxially with the tilting axis 15' of the cam follower 15.

Thus, the axis 15', the shaft axis of the shaft 19, and the journal axis A of the link 24 coincide.

The shifting shaft 19 shown in FIG. 6 is preferably also hollow. The shaft 19 carries at its left-hand end radially outwardly facing gear teeth 19C forming respective entraining elements and at its right-hand end radially outwardly facing gear teeth 19D also forming entraining elements. As shown in FIG. 6, the shifting shaft 19 is in its left-hand position, whereby the gear teeth 19C mesh with the gear teeth 20A and 24B for driving the left-hand link 24 of the four-pivot three-lever drive DL through the cam follower 15 and through the shaft 19. In FIG. 6 the right hand outwardly facing gear teeth 19D of the shaft 19 mesh with gear teeth 21A of the hub 15A of the cam follower 15. In this position of the shaft 19 the teeth 19D do not mesh with the teeth 25B of the cam follower 15 so that the second or right four-pivot three-link drive DL is not driven, only the left drive DL is positively driven as shown in FIG. 6. In this embodiment of FIG. 6 both ends of the shaft 19 are positively driven in the left-hand position and in the right-hand position. There is a play or gap 22 on the left-hand end between the link 24 and the axially facing end of the hub 15A. The gap 22 is sufficient to avoid engagement between the gear teeth 19C and the gear teeth 24B when the shaft 19 is in the right-hand position in FIG. 6. Similarly, there is a gap 23 on the right-hand side sufficient to avoid meshing of the teeth 19D with the teeth 25B when the shaft 19 is in its shown left-hand position in FIG. 6. The arrangement is such, that while driving the link 24 as shown in FIG. 6, the link 25 cannot be driven and vice versa.

Referring again to FIG. 6 the shaft 19 is in its left end position as shown. The cam follower 15 drives the left drive DL through the first link 25 by the meshing of the inwardly facing gear ring 20A with the outwardly facing gear ring 19C and the meshing of 19C with 24B. The shaft 19 oscillates in synchronism with the cam follower 15. The meshing of the inwardly facing gear teeth 25B of the link 25 with the radially outwardly facing teeth 19D of the shiftable shaft 19 is now interrupted. When the shaft 19 is shifted to the right as will be described below, the meshing at 19C and 24B will be disengaged but the teeth 19C will continue meshing with the teeth 20A of the hub 15A at the left-hand end of the shaft 19. Additionally, the drive from the cam follower 15 is also transmitted to the shaft 19 through the meshing of the teeth 21A with the teeth 19D and 19D with 25B thereby driving link 25 but not link 24.

Incidentally, the four-pivot three link right drive DR shares pivots or journals A, B, C, D with the left drive DL and has three links 25, 40 and 44 to be described below.

Referring to FIGS. 1, 2 and 5 in conjunction, the upper end of the link 24 is mounted in bearings 51A supported in the housing 4. The rotational axis of the bearings 51A coincides or is axially aligned with the tilting axis 15' of the cam follower 15. The lower end of the lever 24 is journalled at B to a journal 37 seen in FIGS. 1, 2 and 5. According to the invention, the journal 37 is adjustable in its position. For this purpose the lower end of the segment 59 has a curved or arc-shaped guide section 59B for the journal shaft 37, whereby the position B of the journal shaft 37 is adjustable within the range of the length of the guide section 59B as best seen in FIG. 2. The guide section 59B may be a guide slot. This adjustment of the position of the journal shaft 37 permits in turn varying the angular stroke of the shaft 45 and thus of the slay shaft 46 for determining the pile depth of terry cloth being woven on the loom.

Figure 7:
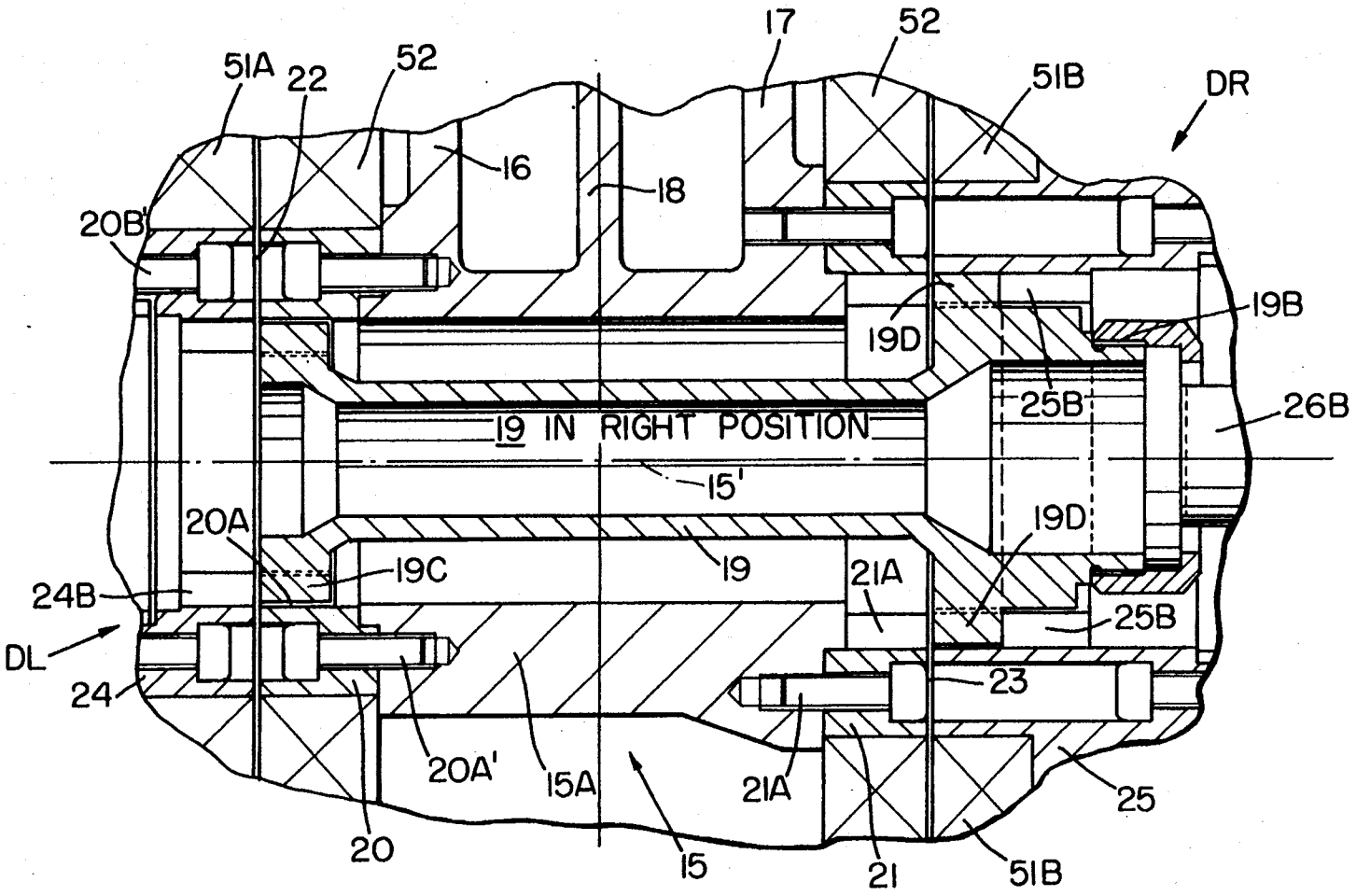
FIG. 7 is a view similar to that of FIG. 6, but showing a modification of the shifting shaft shown in its right position for driving the right four-pivot three-link drive.

Referring to FIGS. 1, 6, and 7 the right-hand four-pivot three-link drive DR is mounted with its first link 25 in bearings 51B so that its rotational or journal axis A also coincides with the tilting axis 15'. The right drive DR comprises a further pivot or journal axis 41 with an axis 41', a second link 40, a third pivot or journal 40' and a third link 44 that is also connected to the shaft 45 having a journal axis 45' so that the journal axis 45' is the fourth pivot D also for the left-hand drive DL. The journal bearing 41 is held in place between the arms 25A of the first link 25 of the right-hand drive DR.

In FIG. 7 the follower motion of the cam follower 15 in response to the rotation of the eccentric cam assembly 7 with the main shaft 3 is transmitted to the shifting shaft 19 either at its left end when the shaft 19 is in its right position, or at its right-end when the shaft 19 is in its left position. As shown in FIG. 7, the shaft 19 is in its right position, thereby receiving the oscillating motion from the follower 15 at the left end of shaft 19 due to the meshing of 19C with 20A for driving DR through 25 etc. When in FIG. 7 the shaft 19 is shifted into its left end position, shaft 19 receives its drive by the meshing of 19D with 21A and drives 24 by the meshing of 24B with 19C.

Figure 4:
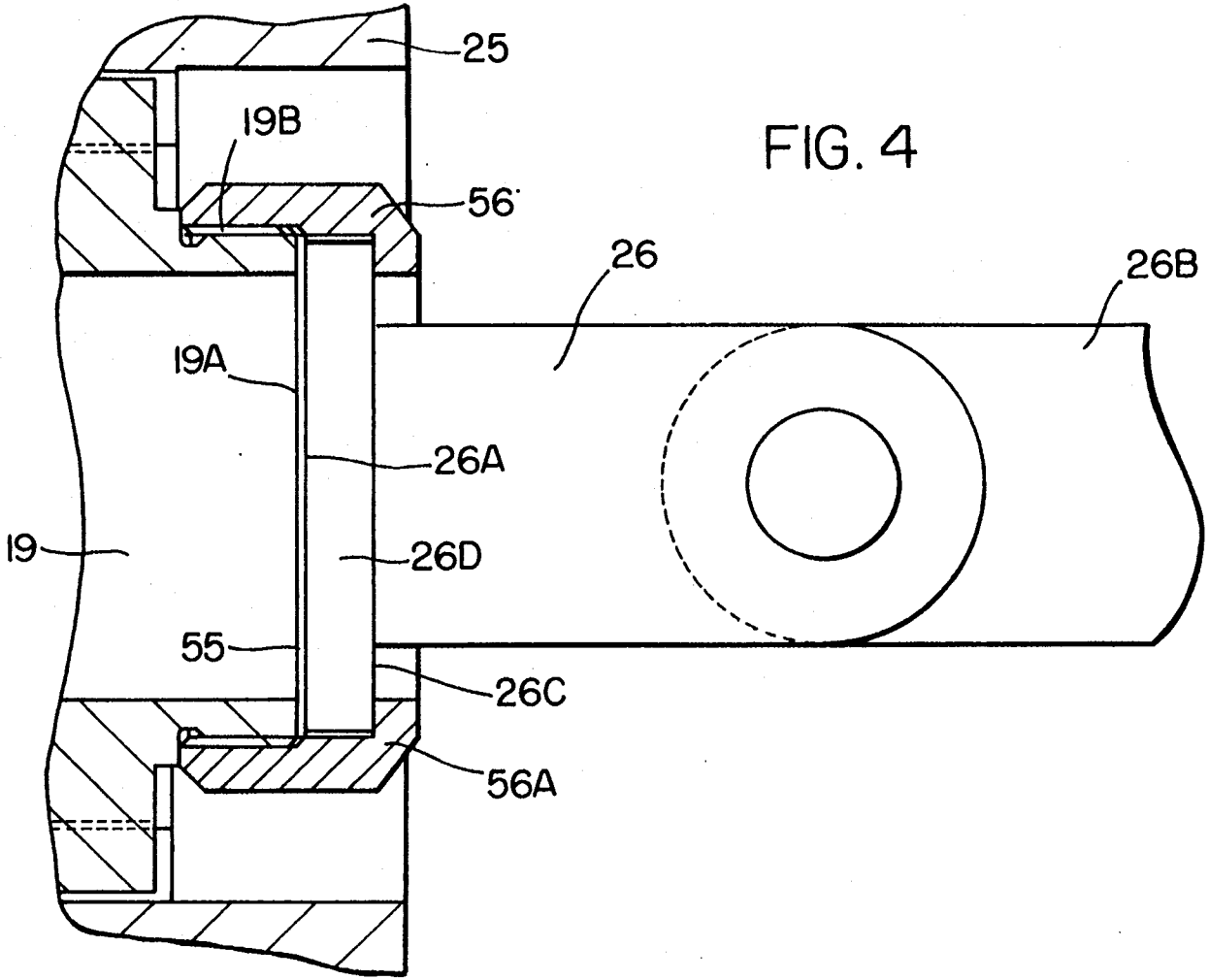
FIG. 4 is an enlarged view of the detail IV in FIG. 1 showing the connection of the engaging and control mechanism to the shifting shaft.

FIG. 4 shows the coupling of shaft 19 with the engagement device 54 and the control 33. The shaft 19 is coupled to a connecting rod 26 by a coupling member 56 that permits relative rotation between the shaft 19 and the connecting rod 26 but transmits an axial shifting force. This rotational decoupling between 19 and 26 is necessary to prevent the transmission of the oscillations of the cam follower 15 to the control 33. For this purpose, the connecting rod 26 has a flange 26D that has an axially facing surface 26A spaced from the axially facing end 19A of the shiftable shaft 19 by a play 55. The opposite face 26C of the flange 26D is engaged by a radially inwardly reaching rim 56A of the coupling member 56. The opposite end of the coupling member 56 is connected to the shaft 19 by an entraining element 19B such as a threading or respective meshing gear teeth facing inwardly on the coupling member 56 and outwardly on the end of the shaft 19 as shown at 19B.

As mentioned above and as shown in FIG. 2, the left-hand drive DL has four pivot axes or journal axes A, B, C and D. The axis A coincides with the tilting axis 15' of the cam follower 15. The pivot axis B coincides with the central axis of the journal 37. The axis C coincides with the journal 42. The axis D coincides with the longitudinal axis of the shaft 45 and thus of the slay shaft 46. The three links of the left-hand drive DL comprise the link or coupling wall 24, the link or coupling rod 38, and the link or coupling rod 43. The right-hand drive DR comprises three coupling rods or links 25, 40 and 44. The four pivot or journal axes for the right-hand drive DR are shown at 15', 41, 40', and 45'. Please see also FIG. 1. While the position of the journal shaft 37 of the left-hand drive DL is adjustable as described above, the position of the respective journal shaft 41 does not need to be adjustable. The link 38 connects in an articulated manner the journal shaft 37 with the journal shaft 42. The link 43 in turn connects the journal shaft 42 with the coupling shaft 45. For these purposes, the shafts are mounted in respective bearings as shown in FIG. 1. The shaft 45 is mounted in bearings 45A also as seen in FIG. 1.

Figure 3:
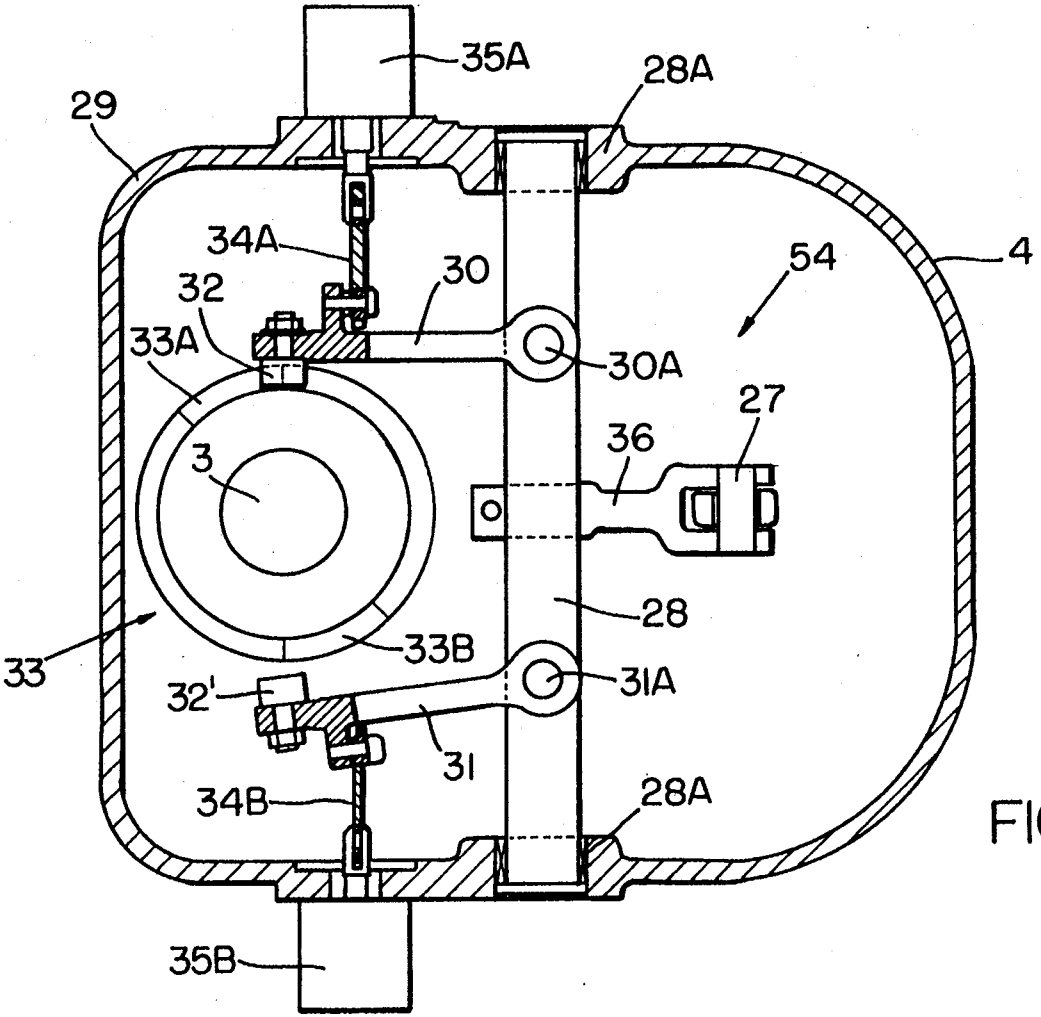
FIG. 3 is a side view, partially in section, in the direction of the arrow III in FIG. 1, showing the engaging and control mechanism for the axial positioning of a shifting shaft for transmitting the angular oscillations of the cam follower to one or the other of the four-pivot three-link drives.

Referring to FIGS. 1 and 3 in conjunction, the engagement mechanism 54 for axially positioning the shiftable shaft 19 either in its left-hand or in its right-hand position will now be described. The engagement mechanism 54 comprises a pair of pivoting levers 30 and 31. The pivoting lever 30 carries at its free end a cam follower roller 32. The pivoting lever 31 carries at its free end a cam follower roller 32'. These cam follower rollers 32, 32' engage a control cam 33A of a control cam mechanism 33 mounted rigidly on the main drive shaft 3 for rotation therewith. At any time only one of the two cam follower rollers 32, 32' is in engagement with the control cams 33A. As shown in FIG. 3 the follower roller 32 engages the respective control cam 33A while the roller 32' is disengaged. This control is accomplished by a respective piston cylinder device 35A, 35B. Preferably, these devices are pneumatic piston cylinders. The control piston 35A is connected through a pull-rod 34A to the pivoting lever 30. A control piston cylinder device 35D is connected through a pull-rod 34B to the pivoting lever 31 for engaging and disengaging the roller 32' witch the respective control cam surface 33B. In order to tilt the levers 30 and 31, they are respectively journalled at 30A and 31A to a shaft 28 mounted in bearings 28A in the housing 4.

Instead of using pneumatic piston cylinder devices 35A, 35B, other control devices can be used, for example, electromagnets, hydraulic piston cylinder devices, or an electric motor can be used for the shifting from the operation of the left-hand drive DL to the right-hand drive DR and vice versa.

Depending on the engagement of the roller 32 or the roller 32' with the respective control cam 33A or 33B, the drive of the main shaft 3 will be transmitted to the shaft 28 to which the tilting levers 30 and 31 are connected as described. A transmitting lever 36 is rigidly connected to the shaft 28, e.g. by clamps, so that the lever 36 performs the respective tilting motions, whereby the lower free end of the lever 36 moves either to the right or to the left as indicated by the double arrow 36A in FIG. 1. The lower end of the lever 36 is journalled by a journal shaft 27 to the coupling member 26B which in turn transmits the movement to the coupling member 26 that shifts the shaft 19 to the left or right as described above. The motion of the shiftable shaft 19 in the axial direction can, for example, be at a ratio of 3:1 for the pile formation relative to the full beat-up of the reed as the latter moves from one end position into the other with an intermediate hesitation for the pile formation.

When the lever 30 is in the leftward position as shown in FIG. 1, the lever 36 is in its right-hand position, thereby shifting the shaft 19 into its right-hand position as shown in FIG. 7, whereby the roller 32 engages the control cam track 33A. As a result, the shaft 19 is in its right-most position as shown in FIG. 7, thereby receiving its driving power by the meshing of the gears 20A and 19C and transmitting its drive by the meshing of the gears 25B and 19D. When the roller 32 is disengaged from the control cam track 33A and the roller 32' is engaged with the control cam track 33B in response to respective operations of the control devices 35A and 35B, the lower end of the coupling member 36 moves to the left, thereby disengaging in FIG. 7 the meshing at 19C and 20A and instead engaging a meshing between 19C and 24B while simultaneously disengaging the meshing of 19D with 25B and engaging the meshing of 19D with 21A, whereby the shaft 19 receives its input drive at its right-hand end, while applying a drive power to the lever 24 at its left-hand end in FIG. 7 due to the meshing at 19C and 24B. The control of the axial shifting of the shaft 19 in FIG. 6 operates in the same way, except for the continuous engagement of the shaft 19 with both its ends with the hub 15A in both end positions of the shaft 19.

Referring to FIG. 2, it will be noted that the fixed journal points or pivot points A, C and D and the adjustable pivot point B permit a very precise positioning of these pivot or journal points compared to the indefinite positions of a toggle joint. Additionally, the arrangement of the three links 24, 38 and 43 on one side of the hub 15A, and of the links 25, 40 and 44 on the other side of the hub 15A of the cam follower 15 results in a very compact drive, which is selectively used for weaving either smooth fabric or terry cloth with the added advantage of a selectable pile depth in the terry cloth.

Referring further to FIG. 2, the slay shaft 46 has mounted thereto a slay support 47 to which the reed shaft 48 is secured, carrying a plurality of reed blades 49. The left-hand full-line position 48', 49' shows the tilted back position of the reed while the right-hand dashed line position shows an intermediate position or a beat-up position of the reed. Heddles 50 are arranged in parallel to the reed 49 as shown symbolically in FIG. 2.

FIG. 5 shows an adjustment drive 57 for varying the position of the journal 37 along guide slot 24D for determining the pile depth of terry cloth. The drive includes an adjustment motor 57A having a shaft 57B to which there is attached a pinion 57C that is driven by the shaft 57B, but is axially movable along the shaft as indicated by the arrow 58. For this purpose, the connection between the pinion 57C and the shaft 57B may comprise a tongue and groove or spline connection that permits an axial movement of the pinion 57C relative to the shaft 57B, but simultaneously rotates the pinion 57C with the shaft 57B. The pinion 57C meshes at 59A with a gear segment 59 secured to the first lever or bar 24 of the left-hand drive DL.

FIG. 5 also shows an arresting or locking mechanism 60 for locking the journal shaft 37 in an adjusted position. For this purpose, the forked arms 24A of the left-hand drive DL are clamped, after adjustment, between the inner side surface of a clamp member 61B and a counter member 62. The locking mechanism 60 comprises a piston cylinder device 61 having a cylinder 61A arranged with its clamp member 61B on that side of one arm 24A, that extends in parallel to the inner wall of the housing 4. A piston 61C is connected to a piston rod 61D. The piston rod 61D passes through the bottom of the cylinder 61A and between the arms 24A of the left-hand drive DL and through the journal 37 of the coupling link 38. The inside free end 61E of the piston rod 61A is held in place by a nut 62 which forms a counter bearing. The cylinder space 61F is pressurized through an inlet port 64 after a position adjustment of the journal 37 has been made. A pressure conduit 65 leads through a coupling 66 from the pressure port 64 through a channel to an inlet 63 of the cylinder space 61F. Once the just mentioned cylinder space 61F is pressurized, the journal 37 is clamped between the arms 24A which yield sufficiently elastically for this purpose. The channel 65 passes coaxially through the first link 24 of the left-hand drive DL to the connector nipple or coupling 66. The pressure control elements for the hydraulic pressure that is applied at the inlet 64 are not shown, since they are conventional. When the pressure in the chamber 61F is released, the journal 37 can be easily adjusted into any desired position within the limits shown at 24C in FIG. 2.

Although the invention has been described with reference to specific example embodiments, it will be appreciated that it is intended to cover all modifications and equivalents within the scope of the appended claims.

What we claim is:

1. A drive system for selectively controlling an angular motion and an angular range of said motion, comprising an angularly movable component (45) to be driven, a power input unit (1) including a driving shaft (3), an eccentric drive cam assembly (7) connected to said driving shaft (3) for rotation with said driving shaft (3), a cam follower (15), at least one cam follower element (11, 12) carried by said cam follower (15) and engaging said eccentric drive cam assembly (7), at least one four-pivot three-link first drive (DL or DR) driven by said cam follower (15), and means connecting said four-pivot three-link first drive to said cam follower (15) and to said angularly movable component (45) for transmitting an angular drive power from said driving shaft (3) to said angularly movable component (45).

2. The drive system of claim 1, comprising a loom slay shaft forming said angularly movable component (46), said system further comprising a four-pivot three-link second drive (DL and DR), said connecting means including a coupling device comprising a shifting shaft (19) and an engaging mechanism (54) for selectively connecting one of said four-pivot three-link first and second drives (DL or DR) to said loom slay shaft (46) for selectively weaving a smooth fabric when said four-pivot three-link first drive (DR) is effective and for weaving a terry cloth when said four-pivot three-link first and second drives (DR and DL) are effective in an alternating manner.

3. The drive system of claim 2, further comprising a gear housing (4), first bearings (52) mounting said cam follower (15) in said housing (4) for tilting about a tilting axis (15') of said cam follower (15), second bearings (51A) mounting said four-pivot three-link first drive in said housing for tilting about said tilting axis (15'), third bearings (51B) mounting said four-pivot three-link second drive in said housing (4) for tilting about said tilting axis (15'), wherein said four-pivot three-link first drive is mounted on one side of said cam follower (15) and said four-pivot three-link second drive is mounted on the other side of said cam follower (15), and so that said cam follower (15), said first drive, and said second drive (DR) have said tilting axis (15') in common.

4. The drive system of claim 3, further comprising an axial spacing (22, 23) between said cam follower (15) and each of said first and second drives (DL, DR) for assuring a proper decoupling of one of said drives (DL or DR) from said cam follower (15) when the other drive is coupled to said cam follower and vice versa.

5. The drive system of claim 3, wherein said cam follower (15) comprises a hollow hub (15A) having a central journal axis coinciding with said tilting axis (15'), said hollow hub (15A) comprising first entraining elements (20A, 21A) at each end of said hub, and wherein said shifting shaft (19) extends through said hollow hub (15A), said shifting shaft (19) having second entraining elements (19C, 19D) for selective cooperation with one or the other of said first entraining elements (20A, 21A), said first and second drives (DL, DR) comprising third entraining elements (24B, 25B) for cooperation with one of said second entraining elements (19C or 19D) for transmitting drive power from said cam follower (15) through said shifting shaft (19) and through said first, second, and third entraining elements to one or the other of said first and second drives.

6. The drive system of claim 5, comprising coupling members (26, 26A, 27, 36) connecting said shifting shaft (19) to said engaging mechanism (54) for selectively moving said shifting shaft (19) into operative engagement with one of said first entraining elements (20A, 21A) and disengagement from the other of said first entraining elements of said hub (15A) for transmitting drive power from said cam follower (15) through said shifting shaft (19) to one of said first or second drives (DL, DR) and for preventing a drive power transmission to the respective other drive (DL or DR).

7. The drive system of claim 6, further comprising a control (33) arranged responsive to said driving shaft (3), said engagement mechanism (54) being operatively coupled to said control (33) and to said shifting shaft (19) for selectively moving said shifting shaft (19) axially from a left end position into a right end position and vice versa.

8. The drive system of claim 7, wherein said coupling members between said shifting shaft (19) and said engaging mechanism (54) comprise a connector rod (26), a lever (36) pivoted to a free end of said connector rod (26), a rotatable shaft (28) rigidly clamped to said lever (36), said rotatable shaft (28) being rotatably mounted in a gear housing section (29), and a pair of tilting levers (30, 31) rigidly connected to said rotatable shaft (28), and wherein said control (33) is connected to said tilting levers (30, 31) for operating said tilting levers (30, 31).

9. The drive system of claim 8, wherein each tilting lever (30, 31) has a free end and carries at said free end a roller (32, 32') which is adapted for camming with a control cam curve (32A) of said control (33), said control (33) being rigidly mounted on said driving shaft (3).

10. The drive system of claim 8, wherein each tilting lever (30, 31) is connected to an adjustment member (35).

11. The drive system of claim 5, wherein each of said first entraining elements (20A, 21A) of said hub (15A) comprises internal gear teeth arranged at both ends of said hollow hub (15A).

12. The drive system of claim 11, wherein said internal gear teeth (20A, 21A) are integral parts of said hollow hub (15A).

13. The drive system of claim 11, wherein said internal gear teeth are separate gear wheels (20, 21) secured to each end of said hub (15A) of said cam follower (15).

14. The drive system of claim 6, wherein said first drive (DL) comprises a first link (24) constructed as an at least partly hollow shaft to form a journal bearing (51A) with a pivot axis (A, 15'), wherein said second drive (DR) comprises a further first link (25) constructed as a completely hollow shaft to form a further journal bearing (51B) with the same pivot axis (A, 15'), and wherein said third entraining elements comprise inner gear teeth (24B, 25B) mounted in said hollow shafts for cooperation with said second entraining elements (19C, 19D) of said shiftable shaft (19).

15. The drive system of claim 14, wherein said entraining elements comprise gear wheels, said inner gear teeth (24B, 25B) forming part of said gear wheels and means securing each gear wheel to said first link (24) and to said further first link (25), respectively.

16. The drive system of claim 2, wherein said engaging mechanism (54) selectively connects said first and second drives (DL, DR) to said loom slay shaft for weaving a smooth fabric or a terry cloth fabric.

17. The drive system of claim 2, wherein each of said first and second drives (DL, DR) comprises four pivots or journals (A, B, C, D) and three links (24, 38, 43; 25, 40, 44), at least one of said first and second drives comprising adjusting means (24C, 57, 59) for adjusting a position of at least one pivot or journal (B) of said four pivots or journal to thereby determine a beat-up motion angle of said loom slay shaft (46) and to further determine a pile depth for weaving terry cloth.

18. The drive system of claim 17, wherein said at least one drive of said first and second drives comprises a locking device (60, 61) for arresting said adjusting means (24C, 57, 59) in an adjusted position to lock said at least one pivot (B) in said adjusted position for weaving terry cloth with a determined pile depth.

19. The drive system of claim 2, wherein each of said first and second drives has a first link (24, 25) each comprising a forked arm (24A, 25A) for holding a journal shaft (37, 41).

20. The drive system of claim 19, further comprising an arresting mechanism (60) including a pressure operated piston cylinder unit (61) having a cylinder (61A) connected to one forked arm (24A) of said forked arms while a piston (61C) is connected to a piston rod (61D) which extends through the bottom of said cylinder (61A), through said arms (24A), and through said journal shaft (37), said piston rod (61D) carrying at its free end (61E) a connecting element (62) supported by one of the arms (24A) as an adjustable abutment, at least one of said arms being sufficiently elastically yielding for locking said journal shaft (37) in an adjusted position, (FIG. 5).

21. The drive system of claim 20, wherein said arresting mechanism (60) is positioned in the area of the forked arm (24A) of said first link (24).

22. The drive system of claim 1, wherein said first drive comprises a first link (24), and a second link (38), a journal shaft (37), means for adjusting said angular range comprising a gear teeth segment (59) having a tilting axis (A) and gear teeth (59A) forming part of said first link (24) of said at least one first drive, said tilting axis (A) of said gear teeth segment (59) coinciding with a tilting axis (15') of said cam follower (15), said gear teeth (59A) meshing with a pinion (57C) that is driven by an adjustment drive (57), and wherein said gear teeth segment (59) of said first drive comprises a guide section (59B) positioned below said tilting axis (A) of said gear teeth segment (59), said guide section (59B) having an arc configuration for said journal shaft (37) which connects said second link (38) of said first drive with said first link (24) of said first drive for permitting an angular position adjustment of said journal shaft (37) of said first drive.

23. The drive system of claim 1, wherein said driving shaft (3) is a main loom drive shaft.

24. A loom comprising a slay shaft, a main loom drive shaft, a drive system connected between said main loom drive shaft and said slay shaft for selectively controlling an angular motion of said slay shaft and an angular range of said slay shaft motion, said drive system comprising a power input unit (1) including said main loom drive shaft (3), an eccentric drive cam assembly (7) connected to said main loom drive shaft (3) for rotation with said main loom drive shaft (3), a cam follower (15), at least one cam follower element (11, 12) carried by said cam follower (15) and engaging said eccentric drive cam assembly (7), at least one four-pivot three-link first drive (DL or DR) driven by said cam follower (15), and means connecting said four-pivot three-link first drive to said cam follower (15) and to said angularly movable slay shaft (45) for transmitting an angular drive power from said main loom drive shaft (3) to said angularly movable component (45).

* * * * *

UNITED STATES PATENT AND TRADEMARK OFFICE

CERTIFICATE OF CORRECTION

PATENT NO. : 5,423,354

DATED : June 13, 1995

INVENTOR(S) : Herrlein

It is certified that error appears in the above-identified patent and that said Letters Patent is hereby corrected as shown below:

Col. 2, line 55, delete ";".

Col. 5, line 39, replace "FIG. 1 is" by --FIGS. 1A, 1B and 1C show--;
line 48, replace "1" by --1C--;
line 51, replace "FIG. 1," by --FIG. 1B,--;
line 56, replace "FIG. 1," by --Fig. 1B,--;
line 59, replace "FIG. 1," by --Fig. 1A--;
line 61, replace "FIG. 1" by --FIG. 1A--;
line 64, replace "FIG. 1" by --Fig. 1A--.

Col. 6, line 9, replace "FIG. 1" by --FIGS. 1A, 1B and 1C are to be viewed as a single Figure by joining Figs. 1A, 1B, 1C along the respective junction planes shown in the drawings. Figs. 1A, 1B and 1C taken together show--, delete "shows";
line 33, replace "FIGS. 1" by --Figs. 1A, 1B, 1C--;
line 45, replace "FIGS. 1" by --Figs. 1A, 1B, 1C--;
line 59, replace "1" by --1A--.

Col. 8, line 3, replace "1," by --1B--.

Col. 9, line 1, replace "1" by --1A, 1B--;
line 22, replace "witch" by --with--;
line 42, replace "1," by --1B,--;
line 53, replace "FIG. 1" by --Fig. 1B--.

UNITED STATES PATENT AND TRADEMARK OFFICE

CERTIFICATE OF CORRECTION

PATENT NO. : 5,423,354

DATED : June 13, 1995

INVENTOR(S) : Herrlein

It is certified that error appears in the above-indentified patent and that said Letters Patent is hereby corrected as shown below:

Col. 13, (claim 17), line 14, replace "journal" by --journals--.

Signed and Sealed this

Twelfth Day of September, 1995

*Attest:*

*Attesting Officer*

Bruce Lehman

BRUCE LEHMAN

*Commissioner of Patents and Trademarks*